United States Patent [19]

Reed et al.

[11] Patent Number: 4,773,504

[45] Date of Patent: Sep. 27, 1988

[54] ROLLING SAFETY TROLLEY

[75] Inventors: Harold L. Reed, Olnev, Ill.; Clarence G. Prichard, Harbour Heights, Fla.; Roger W. Morris, New Lenox, Ill.

[73] Assignee: Union Oil Company of California, Los Angeles, Calif.

[21] Appl. No.: 524,451

[22] Filed: Aug. 18, 1983

[51] Int. Cl.[4] ..... E04G 3/10; E04G 3/16

[52] U.S. Cl. ..... 182/38; 182/142

[58] Field of Search ..... 182/36, 37, 142, 38; 248/323, 340, 214

[56] References Cited

U.S. PATENT DOCUMENTS

| | | | |
|---|---|---|---|
| 434,709 | 8/1890 | Himelberger | 182/36 |
| 572,576 | 12/1896 | Sjolander | 182/36 |
| 654,780 | 7/1900 | Burchill | 182/38 |
| 1,421,609 | 7/1922 | Sturm et al. | 182/37 |
| 1,423,998 | 7/1922 | Camp | 182/38 |
| 1,477,494 | 12/1923 | Hutchison | 182/36 |
| 1,909,742 | 5/1933 | Bone | 182/36 |
| 2,396,127 | 3/1946 | Riblet | 182/37 |
| 2,761,396 | 9/1956 | Harlan | 182/36 |
| 2,854,292 | 9/1958 | Schaeffer | 182/150 |
| 3,114,433 | 12/1963 | Downs | 182/37 |
| 3,124,213 | 3/1964 | Jorsey | 182/38 |
| 3,491,851 | 1/1970 | Dutcher | 182/36 |
| 3,620,331 | 11/1971 | Shaw | 182/36 |
| 4,137,996 | 2/1979 | Brown | 182/150 |

*Primary Examiner*—Reinaldo P. Machado

*Attorney, Agent, or Firm*—Howard R. Lambert; G. Wirzbicki

[57] ABSTRACT

A rolling safety trolley for traversing the upper circumference of an open tank having a top ledge comprises: a frame having an upright member and at least one cross member, and preferably a plurality of cross members, an outer wall roller affixed to the extremity of each of said crossmembers and adapted to engage and roll along the outer wall surface of said tank, a hooked member affixed to the uppermost portion of said upright member, a top ledge roller affixed to said hook member and adapted to engage and roll along said top ledge, and an inner wall roller affixed to said hook member and adapted to engage and roll along the inner wall of said tank.

2 Claims, 1 Drawing Sheet

ROLLING SAFETY TROLLEY

BACKGROUND OF THE PRIOR ART

1. Field of the Invention

The instant invention relates to a safety device useful in fighting fires in open tanks and other vertical structures wherein a fire fighter has to be able to traverse the upper extremity of the structure in order to fight the fire. This device is especially useful in fighting fires in oil tanks having floating roofs.

2. Backgroung of the Prior Art

Movable suspension devices adapted for use in securing and supporting workmen in an elevated position adjacent a vertical building wall are well known in the art. Such devices may be constructed to enable the workman to move selectively, horizontally and vertically, to a desired position along the wall. Generally such devices are supported on the parapet or upper wall ledge of the building or other vertical structure, such as a bridge, tower, fence, etc. A device of this sort is disclosed in U.S. Pat. No. 3,620,331. This device would not be useful for fighting fires in an open tank since the workman is held suspended at a point below the portion of the device which engages the upper ledge or parapet of the building. In such position, the workman would not be able to peer over the upper edge of the tank and direct water or other fire-suffocating agent into the interior of the open tank. Furthermore, in this device the workman is seated on a suspended support platform. It is clear that during movement of the platform the worker is secured only by his ability to maintain his grasp on the cables attached to the supporting platform. In particular, there is no method for securing the workman to the device other than the workman's own physical grasp.

Fire escapes which are affixed to the upper portion of the building to enable occupants of the building to flee to the ground in the event of a fire are also well known.

In U.S. Pat. No. 434,709, a ladder is secured to a rope which traverses the outer walls of a typical building. Again, this device would not be useful in conjunction with an open tank since there is no independent means for securing a fire fighter, who would have to be able to manipulate a hose or other devices to smother the fire. Furthermore, the device would not enable the fire fighter to extend himself above the top of a tank since the device terminates at the point at which it is secured to the ledge. Finally, this reference is inapplicable to fighting fires in tanks, in that the purpose of the device is to enable a person to exit from some point in the building to the ground as opposed to enabling a person to maintain himself at the upper circumference of the tank for the purpose of peering into and fighting a fire contained therein.

Therefore, it is one object of this invention to provide a device to enable a fire fighter to traverse the upper circumference of an open tank in a position to enable him to peer into and fight a fire by directing a fire smothering agent into the tank.

It is another object of this invention to provide a safety device which the fire fighter can propel about the circumference of a tank by his own physical effort while fighting a fire therein.

It is another object of this invention to provide a device which is easily and quickly secured to the top of an open tank for the purpose of securing a fire fighter thereto.

Other objects and advantages of the instant invention will be apparent from a careful reading of the specification below.

BRIEF DESCRIPTION OF THE INVENTION

The instant invention provides a rolling safety trolley for traversing the upper circumference of an open tank having a top ledge which comprises a frame having an upright member and at least one cross member and preferably a plurality of cross members, an outer wall roller affixed to the extremity of each of said crossmembers and adapted to engage and roll along the outer wall surface of said tank, a hooked member affixed to the uppermost portion of said upright member, a top ledge roller affixed to said hook member and adapted to engage and roll along said top ledge, and an inner wall roller affixed to said nook member and adapted to engage and roll along the inner wall of said tank.

BRIEF DESCRIPTION OF THE DRAWING

This invention will be more readily understood by reference to the drawing figures wherein like numerals refer to like elements and in which.

DETAILED DESCRIPTION OF THE INVENTION

Figure 1:
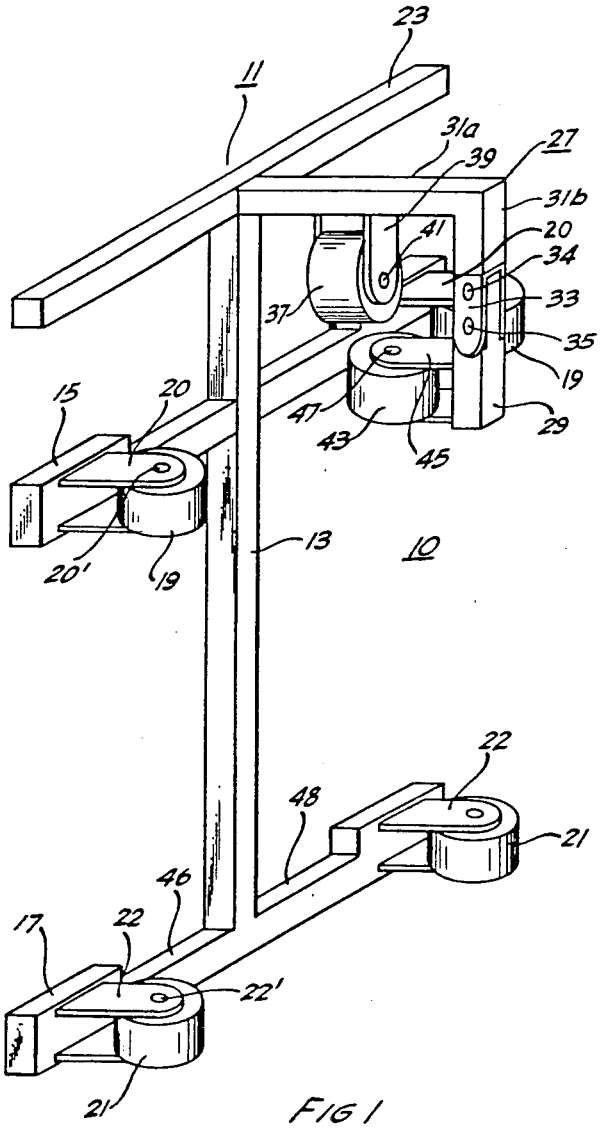
FIG. 1 is an isometric view of a preferred embodiment of the rolling safety trolley of this invention.

Referring now to the figures of the drawing, a rolling safety trolley designated generally as 10 has a frame 11 comprising an upright member 13, a first cross member 15, and a second cross member 17, with members 15 and 17 being located downwardly or below the uppermost portion of upright member 13 and preferably being perpendicular to upright member 13. Cross members 15 and 17 support rollers 19 and 21, respectively, which are secured to the cross members at the extremities thereof by forks 20 and 22, and axle pins 20' and 22'. As shown, each of the extremities of said first and second downwardly located cross members is provided with a similar roller, and it is proposed that rollers 21 and 19 be equidistant from upright member 13.

Figure 2:
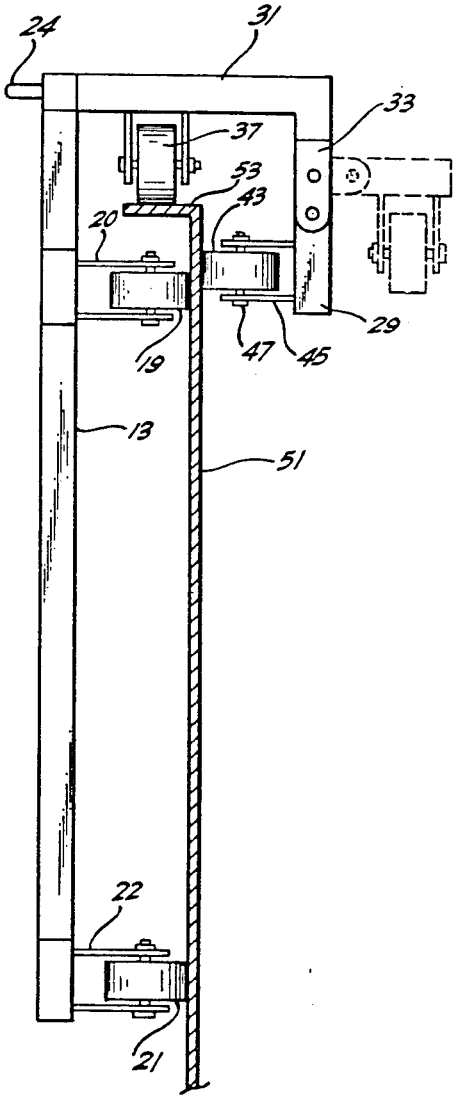
FIG. 2 is a cross-sectional view of the wall of an open tank to which the preferred embodiment of the rolling safety trolley of this invention is engaged and further showing the movement of the rotatable member whereby the inner wall engaging roller engages and disengages the inner wall of said open tank.

The frame is also comprised of a third upwardly located cross member 23 to which is affixed one or more rings 24 for securing a fire fighter (See FIG. 2). Any arrangement of rings affixed anywhere along such third support member is suitable. However, two rings affixed at the extremities of the third cross member is preferred to enable two fire fighters to be secured to the rolling safety trolley of this invention without hindering each other's fire-fighting efforts.

A hinged hook 27 is affixed to and extends perpendicularly from the uppermost and central portion of said frame. Said hinged hook includes a fixed member 31 having a horizontal portion **31*a* secured to and extending perpendicularly from said frame and a vertical portion 31*b* extending downwardly in a direction parallel to upright member 13. Thus, as shown, the fixed member is preferably an L-shaped member. Said L-shaped member terminates in or is secured to a fork 33 which is bored to provide passages for a fixed pin 35 and a removable pin 34** as shown.

The hinged hook further includes a rotatable member 29 which is sized to fit between the tines of said fork 33. The rotatable member is also bored with such bores registering with the bores of said fork whereby the rotatable member may be secured in a rigid position by combination of such fixed pin 35 and such removable pin 34. Furthermore, when said removable pin is removed, the rotatable member may be rotated as shown in FIG. 2 to an orientation which is not parallel (and preferably, perpendicular) to upright member 13.

The horizontal portion 31*a* of said L-shaped member 27 supports a roller 37 which is secured thereto by means of a fork 39 and pin 41. As shown in FIG. 2, roller 37 will engage and roll along the upper ledge 53 of tank 51. Roller 43 is affixed to said rotatable member 29 by means of fork 45 and pin 47. Roller 43 engages and rolls along inner wall of the tank 51 when said roller is rotated into position and rigidld with the removable pin 34.

The rolling safety trolley of this invention is secured to the top of an open tank by placing rollers 21 and 19 in engaging relationship with the outer wall of said tank and roller 37 with the upper ledge of said tank. The rotatable member carrying roller 43 is rotated into engaqement with the inner wall of said tank and removable pin 34 is pushed through the appropriate bore to rigidly engage such roller 43 against the inner wall of the tank. With this rigid engagement the rolling safety trolley is free to move about the circumference of the tank; however, it cannot move up or down in a vertical direction. Moreover, the rolling safety trolley cannot slip from engagement with the tank and therefore a fire fighter secured thereto is assured of a safe position.

The fire fighter can roll the safety trolley in any direction about the circumference of the tank while standing on a wind girder, i.e., a platform circumventing the tank at a point about three to five feet below the top. The fire fighter may be secured to the safety trolley by connecting his safety belt to ring 24. Furthermore, the fire fighter can support himself, if necessary, by standing on supporting portions 46 and 48 of the downwardly located crossmember affixed to the downward most portion of said upright member. The rolling safety trolley thus enables the fire fighter to maintain his hands free for manipulation of a hose or other device to smother fire in the interior of the tank. Furthermore the fire fighter can easily move circumferentially about the tank while remaining secured to the safety trolley.

The frame and forks are conveniently fabricated from steel, for example tubular steel, and the rollers may be conveniently of rubber. Suitable materials of construction for the rolling safety trolley are known in the art and therefore need not be discussed herein.

The rolling safety trolley of this invention is sized to enable the fire fighter to peer over and view the internal area of the open tank. Positioning of roller 37 enables rolling safety trolley to extend above uppermost edge of the open tank. The upper member is usually sized to no more than 4 feet preferably no more than 3 feet so that the safety trolley will fit between the wind girder and the top of the tank.

While particular embodiments of the invention have been described, it will be understood of course that the invention is not limited thereto. Since many obvious modifications can be made, it is intended to include within this invention any such modifications as will fall within the scope of the appended claims.

We claim:

1. A rolling safety trolley for securing a fire fighter to an open tank, and enabling said fire fighter to traverse the circumference of said tank, at the top ledge thereof, in position to peer into and fight a fire by directing a fire-smothering agent into said tank, which comprises:

a frame having an upright member and at least one cross member, outer wall rollers affixed to the extremities of said cross member and adapted to engage and roll along the outer wall surface of said tank, a hooked member affixed to the uppermost portion of said upright member, a top ledge roller affixed to said hooked member and adapted to engage and roll along said top ledge, an inner wall roller affixed to said hooked member and adapted to engage and roll along the inner wall of said tank, said hooked member comprising a fixed member extending perpendicular to said upright member and a rotatable member adapted to rotate to a position parallel to said upright member; and means for securing said fire fighter to said rolling safety trolley, said securing means comprising a ring for securing the fire fighter thereto affixed to each extremity of said at least one cross member.

2. A rolling safety trolley for traversing the upper circumference of an open tank having a top ledge which comprises:

(a) a frame comprising an upright member, first and second downwardly located crossmembers and a third upwardly located cross member, (b) rollers affixed to the extremities of said first and second crossmembers and adapted to engage the outer wall surface of said tank, (c) rings affixed to the extremities of said third cross member and adapted to be secured to the safety belt of a fire fighter, (d) a hinged hook affixed to and extending perpendicularly from the uppermost portion of said frame, said hinged hook including a rotatable member, (e) a first roller affixed to said hinged hook and adapted to engage and roll along said upper ledge of said tank, and (f) a second roller affixed to said rotatable member and adapted to engage and disengage the inner wall of said tank upon rotation of said rotatable member.

* * * * *